United States Patent [19]

Rohrer

[11] Patent Number: 4,844,108

[45] Date of Patent: Jul. 4, 1989

[54] TENT

[75] Inventor: Daniel F. Rohrer, Redmond, Oreg.

[73] Assignee: Pyromid, Inc., San Jose, Calif.

[21] Appl. No.: 114,727

[22] Filed: Oct. 30, 1987

[51] Int. Cl.[4] ..... E04H 15/12

[52] U.S. Cl. ..... 135/91; 135/92; 135/100; 135/116; 135/120; 126/364; 126/31

[58] Field of Search ..... 135/72, 99, 100, 91, 135/93, 117, 116, 120; 126/364, 31

[56] References Cited

U.S. PATENT DOCUMENTS

| | | | |
|---|---|---|---|
| 214,996 | 5/1879 | Doane | 135/100 |
| 396,846 | 1/1889 | Ancel | 135/92 |
| 522,483 | 7/1894 | Noonan | 135/92 |
| 1,275,193 | 8/1918 | Alsobrook | 126/364 |
| 1,533,820 | 4/1925 | Whitehead | 135/99 |
| 1,543,134 | 6/1925 | Todd | 135/99 |
| 2,381,548 | 8/1943 | McLaughlin | 126/307 R |
| 2,601,865 | 7/1952 | Campbell | 135/100 |
| 2,681,057 | 6/1954 | George | 126/364 |
| 2,876,783 | 3/1959 | Ames | 135/99 |
| 2,928,403 | 3/1960 | Hoskins | 135/98 |
| 2,931,323 | 4/1960 | Larson | 135/116 |
| 3,181,543 | 5/1965 | Petrie | 135/92 |

*Primary Examiner*—Henry E. Raduazo
*Attorney, Agent, or Firm*—Jack M. Wiseman

[57] ABSTRACT

A tent supported by a center pole in which the center pole serves as a chimney for a stove disposed within the tent. A water jacket surrounds the center pole for heating water stored in the water jacket. The center pole is formed from pole segments with are nested on top of another through a slip fit connection, whereby the center pole can be disassembled for transporting and storing.

7 Claims, 2 Drawing Sheets fig_5
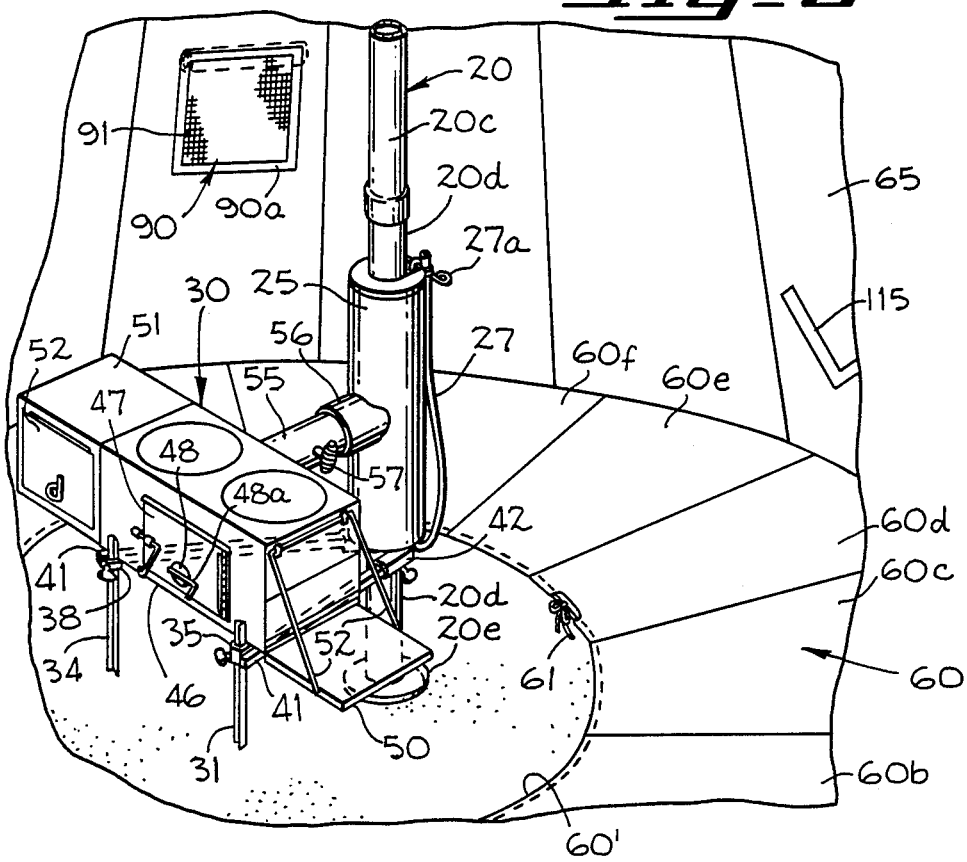
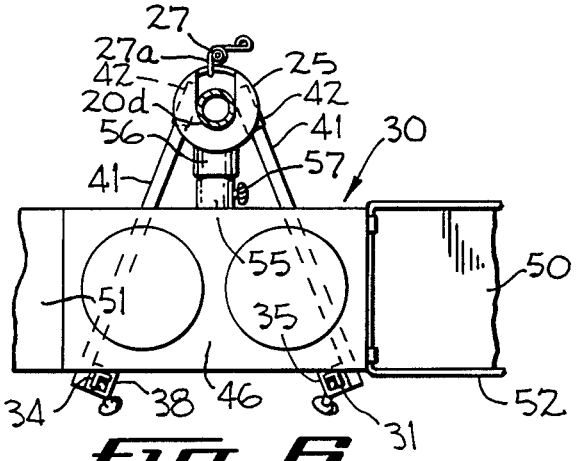
fig_6
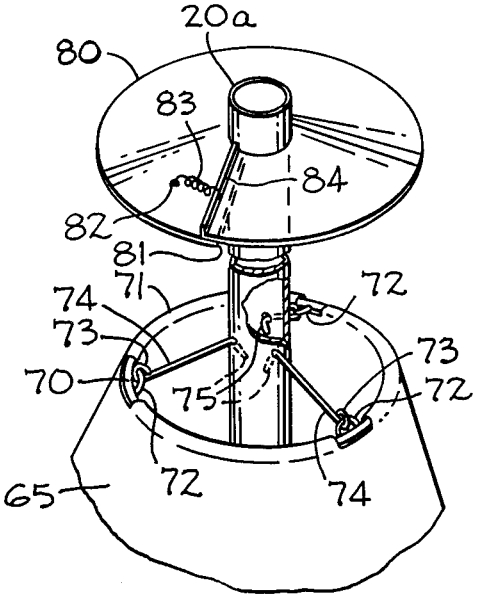
fig_7

TENT

BACKGROUND OF THE INVENTION

The present invention relates in general to tents, and more particularly to a tent having a center pole for supporting the tent in the upright state.

Heretofore, pyramid-type tents were supported by a center pole. The center pole functioned solely as a support member for the tent covering and as a support for hanging articles.

SUMMARY OF THE INVENTION

A tent supported by a center pole in which the center pole serves as a chimney for a stove disposed within the tent.

An object of the present invention is to provide a tent supported by a center pole in which the pole is used for functions other than to support the tent or to support articles suspended therefrom.

A feature of the present invention is that the center pole supporting the tent cover is tubular and serves as a chimney for a stove disposed within the tent.

Another feature of the present invention is that the center pole supporting the tent cover is tubular to serve as a chimney for a stove disposed within the tent and a cylindrical water vessel surrounds the chimney to heat the water contained in the cylindrical water vessel.

Another feature of the present invention is that the tent has a floor covering with a center opening and a drawstring adjusts the diameter of the center opening of the floor covering of the tent.

Another feature of the present invention is the employment of a weather cap at the top of the tent that is supported by the center pole of the tent and an inner wall surrounding the center opening of the weather cap is self-adjusting for gripping the center pole of the tent.

DESCRIPTION OF THE DRAWINGS

FIG. 5 is an enlarged, fragmentary, perspective view of the interior of the tent shown in FIGS. 1–3.

FIG. 6 is an enlarged, horizontal section view taken along line 6—6 of FIG. 3 and illustrating the stove, the center pole and the interconnecting conduits in elevation.

FIG. 7 is an enlarged perspective view of a storm cap and a top support ring for the tent shown in FIGS. 1–3 and illustrated with the center pole and a portion of the sidewall of the tent shown in FIGS. 1–3.

DESCRIPTION OF THE PREFERRED EMBODIMENT

Figure 1:
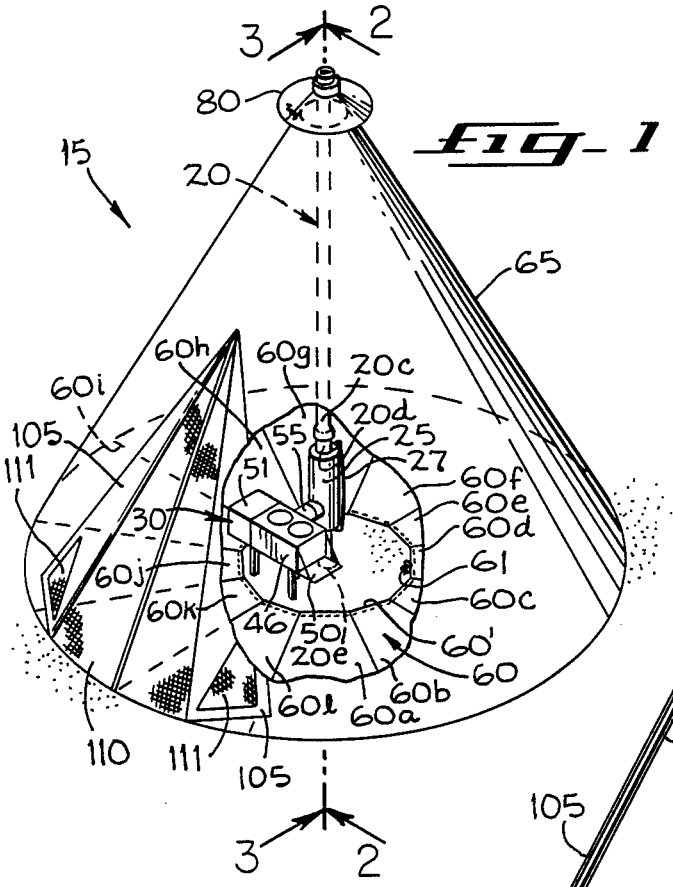
FIG. 1 is a front elevation view of a tent embodying the present invention with a portion of the sidewall thereof broken away to illustrate partially the interior of the tent.
Figure 2:
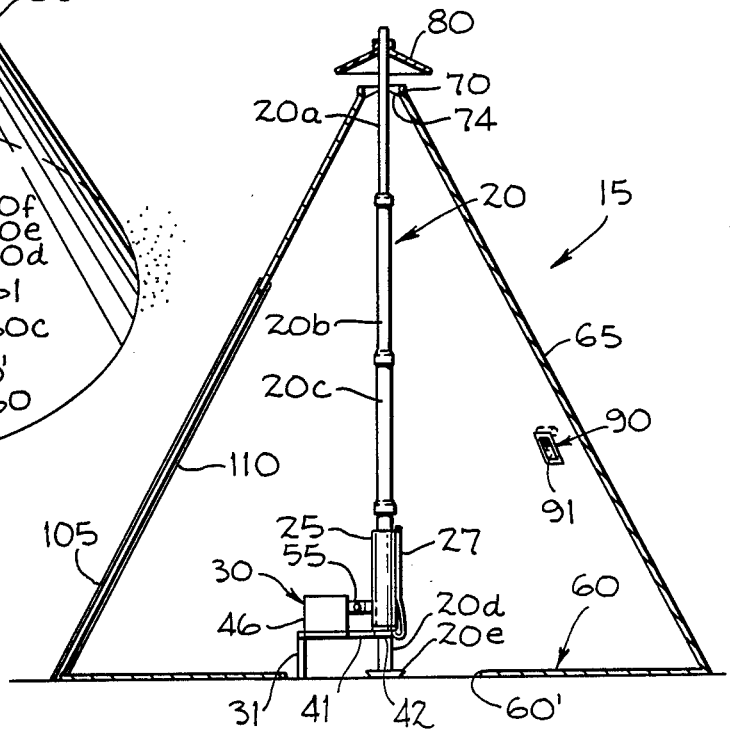
FIG. 2 is a vertical sectional view taken along line 2—2 of FIG. 1 and shown partially in elevation.
Figure 3:
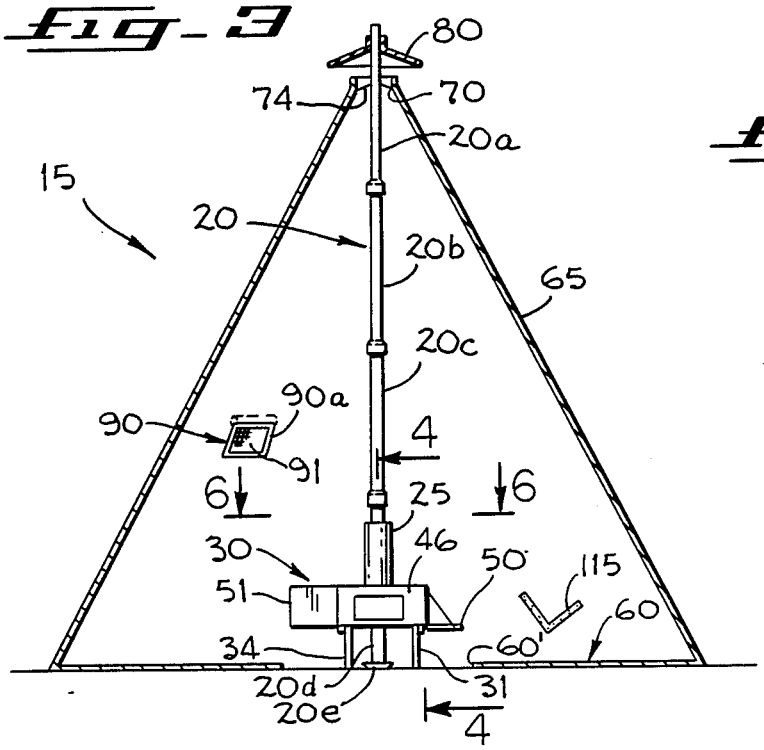
FIG. 3 is a vertical sectional view taken along line 3—3 of FIG. 1 and shown partially in elevation.
Figure 4:
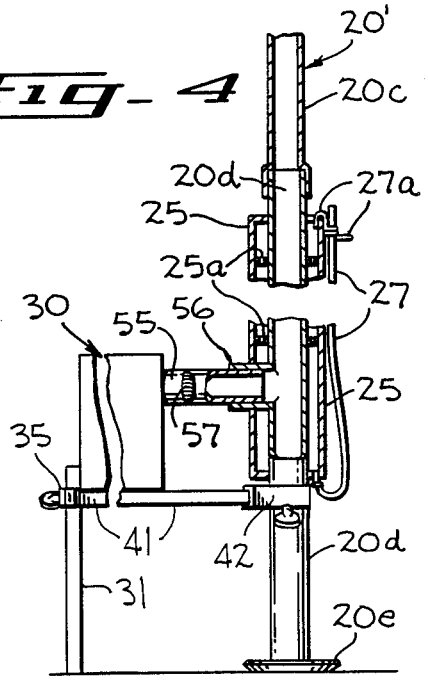
FIG. 4 is an enlarged, fragmentary, vertical sectional view taken along lines 4—4 of FIG. 3 and showing a center pole and stove partially in elevation.

Illustrated in FIGS. 1–3 is a tent 15 comprising a segmented, tubular center pole 20 (FIGS. 2–4). In the exemplary embodiment, there are four tubular segments 20*a*–20*d* for the center pole 20. The uppermost pole segment 20*as* projects above the remaining components of the tent 15. The lower end of the pole segment 20*a* is flared to accommodate a close slip fitting with the top of the adjacent pole segment 20*b*. Thus, the pole segment 20*a* through its flared lower end seats on the upper end of the pole segment 20*b* and the upper end of the pole segment 20*b* is nested in the flared end of the pole segment 20a in an air tight relation. The diameter of the pole segment 20*b* is greater than the diameter of the pole segment 20a and provides an air tight, close fit between the flared lower end of the pole segment 20*a* and the upper end of the pole segment 20*b*.

In a similar manner, the lower end of the pole segment 20*b* is flared to accommodate a close slip fitting with the upper end of the adjacent pole segment 20*c*. Hence, the pole segment 20*b* through its flared lower end seats on the upper end of the pole segment 20*c* and the upper end of the pole segment 20*c* nests in the flared lower end of the pole segment 20*b* in an air tight relation. The diameter of the pole segment 20*c* is greater than the diameter of the pole segment 20*b* and provides an air tight, close fit between the flared lower end of the pole segment 20*b* and the upper end of the pole segment 20*c*.

Likewise, the lower end of the pole segment 20*c* (FIG. 4) is flared to accommodate a close slip fitting with the upper end of the adjacent pole segment 20*d*. Therefore, the pole segment 20*c* through its flared lower end seats on the upper end of the pole segment 20*d* and the upper end of the pole segment 20*d* nests in the flared lower end of the pole segment 20*c* in an air tight relation. The diameter of the pole segment 20*d* is greater than the diameter of the pole segment 20*c* and provides an air tight, close fit between the flared lower end of the pole segment 20*c* and the upper end of the pole segment 20*d*. At the bottom of the pole segment 20*d* is a suitable flat base 20*e* with upturned flanges for engaging the ground for contributing to the stabilization of the center pole 20 on the supporting surface. By virtue of the slip fitting between successive pole segments 20*a*–20*d*, the pole 20 can be erected to a full height and can be disassembled into separated pole segments for transporting and storing.

Surrounding the pole segment 20*d* is a water jacket or vessel 25 (FIGS. 1–6) having a circular cross-sectional area. Annular stiffener plates 25*a* are disposed within the vessel 25 and surround the center pole 20 for structural reinforcement. The bottom wall of the water jacket 25 is welded or otherwise suitable secured to the outer wall of the pole segment 20*d* to be permanently secured thereto in a liquid-tight relation. A suitable transparent hose 27 is connected at the proximal end thereof to the bottom of the vessel 25 through a nipple carried by the vessel 25. A suitable hose clamp secures the free end of the hose 27 to the nipple of the vessel 25. In the exemplary embodiment, the hose 27 is surrounded by a suitable wire coil 27*a* to removably attach the discharge end of the hose 27 to the top of the vessel 25. The wire coil 27*a* also serves as a handle for the hose 27. Through this arrangement, the hose 27 removes water from the vessel 25. Water is poured into the vessel 25 through the access opening at the top of the vessel 25.

Connected to the vessel 25 is a suitable stove 30 (FIGS. 1–). In the exemplary embodiment, the stove 30 is a collapsible, stainless steel, wood burning stove. The stove 30 includes a firebox and cooking unit 46 which is supported by legs 31 and 34. An oven 51 is secured to one side of the firebox and cooking unit 46. Mating upper edges along confronting sides of the oven 51 and the firebox and cooking unit 46 have conforming flanges and grooves which are welded together for supporting the oven 51 from the firebox and cooking unit 46.

On the opposite side of the firebox and cooking unit 46 is a pivotally supported utility tray 50. The utility tray 50 is hinged to the lower end of the confronting side of the firebox and cooking unit 46. Wire suspensions 52 support the outboard side of the utility tray 50 from the confronting side of the firebox and cooking unit 46. A hinged door 47 with a damper 48 and a handle 48*a* is provided for the firebox and cooking unit 46. The sides of the firebox and cooking unit 46 are hinged and the panels thereof are hinged in parallel transverse relation for folding the firebox and cooking unit 46 to make it collapsible for storing and transporting.

In the exemplary embodiment, the legs 31 and 34 have L-shaped cross-sectional areas, such as right angle members. Adjustably secured to the legs 31 and 34, respectively, are clamps 35 and 38. The clamps 35 and 38 are tubular and have a square cross-sectional area to receive the legs 31 and 34, respectively, and for adjustable securement to the legs 31 and 34 by means of screws. Welded to the clamps 35 and 38, respectively, are horizontally disposed arms 41. The arms 41 are directed inwardly toward one another from the stove 30 toward the center post 20. The arms 41 are tubular members with square cross-sectional areas. The ends of the arms 41 in the vicinity of the center pole 20 are received by tubular sleeves 42, respectively. The tubular sleeves 42 have square cross-sectional areas. The sleeves 42, in turn, are welded to the center pole 20. Thus, the stove 30 is supported by the legs 31 and 34 and also by the center pole 20 through the arms 41.

Extending from the firebox and oven enclosure 46 is one end of a stove pipe 55 (FIGS. 4–). The stove pipe 55 embraces at the opposite end and is received by a press fit in a pipe fitting or connection 56 that is welded in an air tight relation to the pole segment 20*d*. An opening is formed in the pole segment 20*d*, which communicates with the pipe connection 56 but is otherwise sealed off by the pipe connection 56. In turn, the pipe connection 56 receives in an air tight relation the other end of the stove pipe 55. The stove pipe 55, in turn, communicates with the interior of the firebox of the enclosure 46 through an opening formed in a wall of the enclosure 46. The stove pipe 55 is press-fitted to the enclosure 46. The stove pipe 46 communicates with the opening in the enclosure 46, but, otherwise seals off the opening formed in the enclosure 46. The vessel 25 receives the pipe connection 56 and is suitably secured thereto in water-tight relation by welding or the like. Thus, heat and smoke created within the enclosure 46 are conducted from the enclosure 46, through the stove pipe 55, through the pipe fitting 56 and through the center pole 20. Smoke emanating from the stove 30 is discharged into the atmosphere through the upper end of the pipe segment 20*a*. Thus, the center 20 serves as a chimney for the stove 30. Heat created by the fuel burning within the stove 30 passes through the pole segment 20*d* and the pipe connection 56 to heat the water stored in the vessel 25. A damper 57 (FIGS. 4–6) for the stove pipe 55 controls the flow of smoke and ventilation from the firebox of the enclosure 46 to the center pole 20.

In FIGS. 1 and 5 is illustrated a ground cover 60 for the tent 15. The ground cover 60, in the exemplary embodiment, has an annular configuration with a center opening 60' large enough to accommodate the stove 30 (FIG. 5). In the exemplary embodiment, the ground cover 60 comprises twelve panels 60*a*–60*l*. Each panel is in the form of a sector. The ground cover 60, in the preferred embodiment, is made of a suitable fire retardant nylon fabric, such as 1000 denier nylon cordura, urethane coated DWR. Along the inner wall of the ground covering 60 is a drawstring 61 (FIGS. 1 and 5) to enable the inner diameter of the center opening 60' of the ground cover 60 to be adjusted once the tent 15 has been assembled for use.

The sidewalls 65 (FIGS. 1–3) of the tent 15 are formed from a suitable, fire-retardant nylon fabric. In the preferred embodiment, the sidewalls 65 are formed of 1000 denier nylon cordura, urethane coated DWR. The walls 65 have a generally conical configuration. At the top of the walls 65 is a ring 70 (FIGS. 1–3 and 7). The ring 70 (FIG. 7) is received by fabric tubing 71 of the sidewalls 65. The fabric tubing 71 is formed by a fabric hem sewn at the top of the sidewalls 65. The tubing 71 has sections spaced apart equal angular distances. Welded to the ring 70 are suitable links 72, which are spaced apart angularly by 120°. Coupled to the links 72 through links 73 are radial connectors 74. At the free end of the connectors 74, respectively, are hooks 75, which are received by suitable openings in the pole segment 20*a*.

Above the ring 70 is disposed a weather cap 80 (FIGS. 1–3 and 7). The weather cap 80 has a generally frusto-conical configuration and, in the preferred embodiment, is made of stainless steel. Formed in the weather cap 80 is a radial slit 81 to provide separable, overlapped sections for the weather cap 80 to enable the conical configuration of the weather cap 80 to be adjustable as to dimensions. The slit 81 extends the full radial distance of the weather cap 80. On one side of the slit 81 is an opening 82 in which one end of a tension spring 83 is anchored. The other end of the spring 83 is fixed to the cap 80 at the other side of slit 81 by a suitable upright flange 84. Through this arrangement, the spring 83 self-adjusts the diameter of the inner wall of the weather cap 80 surrounding the center opening thereof so as to securely hold the weather cap 80 about the pole segment 20*a* and above the ring 70 of the side walls 65 by gripping the center pole segment 20*a*.

Formed in at least one side wall 65 is a window 90 (FIG. 5), which is made of a heavy duty solar screen 91. The sidewall 65 includes a suitable opening about which is sewn a window frame 90*a* within the fabric of the side wall 65. The solar screen 91 is received within the opening formed in the sidewall 65 and secured by the frame sewn around the opening to the sidewall 65. The cut-away portion of the fabric of the sidewall 65 forms a flap that may be retained above the window 90 or may be rolled over the window 90. Velcro closures hold the flap in place. The flap is on the outside of the side wall 65 to prevent water from entering the interior of the tent 15.

For securing the bottom edges of the side walls 65 to the ground, ground loops and ground stakes are employed in a well-known and conventional manner. The arms are secured to the pole segment 20*d* and the legs 34 and 31, respectively, of the stove 30 for rigidifying and stabilizing the connections between the stove 30 and the center pole 20.

At the entrance to the tent 15 (FIG. 1) there is an outer cover 105 and an inner cover 110. The outer cover 105 is a suitable fabric flap made of the same material as the sidewalls 65 and provides a suitable cover for the opening defining the entrance to the tent 15. At the lower section of the outer cover 105 are openings which are covered with fiberglass solar screen 111 to allow ventilation when the entrance to the tent 15 is covered by the outer cover 105.

The inner cover 110 is made of a fiberglass solar screen material, which allows ventilation and prevents insects from entering the tent 15. A zipper with an iridescent pull is provided on the inner cover 110 to facilitate the operation thereof in the dark. An emergency exit 115 (FIG. 3) is provided in the sidewall 65, which is held in a closed position by Velcro fasteners.

What is claimed is:

1. A tent comprising:

(a) a tubular pole supported at a lower end thereof by a support surface;

(b) a sidewall with an opening defined by the uppermost edge of the sidewall, said tubular pole at the upper end thereof being received by said opening defined by the uppermost edge of the sidewall, said sidewall at the upper end thereof being attached to said pole to be supported thereby;

(c) a heating unit disposed within a space defined by said sidewall;

(d) conducting means interconnecting said heating unit and said tubular pole for conducting the passage of smoke and heat from said heating unit through said tubular pole; and (e) a vessel for storing liquid disposed about said tubular pole for heating liquid stored in said vessel, said vessel being formed with a radially disposed opening therein to receive said conducting means in an air tight relation.

2. A tent comprising:

(a) a tubular pole supported at a lower end thereof by a support surface;

(b) a sidewall with an opening defined by the uppermost edge of the sidewall, said tubular pole at the upper end thereof being received by said opening defined by the uppermost edge of the sidewall, said sidewall at the upper end thereof being attached to said pole to be supported thereby;

(c) a heating unit disposed within a space defined by said sidewall;

(d) conducting means interconnecting said heating unit and said tubular pole for conducting the passage of smoke and heat from said heating unit through said tubular pole, (e) said sidewall including a ring attached to said sidewall in the vicinity of the opening defined by the uppermost edge of said sidewall;

(f) means interconnecting said ring with said tubular pole for said tubular pole to support said sidewall in the vicinity of the opening defined by the uppermost edge of said sidewall; and (g) a weather cap disposed above said opening defined by the uppermost edge of said sidewall, said weather cap including a center opening for receiving said tubular pole in supporting engagement therewith, said weather cap having a generally frusto-conical configuration, said weather cap including an inner cylindrical wall and an outer cylindrical wall, said weather cap including a slit extending from said outer cylindrical wall to said inner cylindrical wall, wherein said weather cap overlaps in the vicinity of said slit, said weather cap including a tension spring interconnecting sections of said weather cap separated by said slit for urging the inner cylindrical edge of said weather cap to grip said tubular pole for said tubular pole to support said weather cap.

3. A tent comprising:

(a) a tubular pole supported at a lower end thereof by a support surface;

(b) a sidewall with an uppermost edge and an opening defined by the uppermost edge of the sidewall, said tubular pole having an upper end received by said opening defined by the uppermost edge of the sidewall, said sidewall having an upper end attached to said pole to be supported thereby;

(c) a heating unit disposed within a space defined by said sidewall;

(d) conducting means interconnecting said heating unit and said tubular pole for conducting the passage of smoke and heat from said heating unit through said tubular pole; and (e) a floor covering having an inner cylindrical wall and an outer cylindrical wall, said floor covering comprising a draw string along the inner wall thereof for adjusting the size of a space defined by a center opening surrounded by said inner wall, said floor covering comprising a plurality of arcuate sector panels joined along contiguous radial sides thereof.

4. A tent as claimed in claim 3 wherein said space defined by the center opening surrounded by said inner wall being sufficient to accommodate said heating unit.

5. A tent comprising:

(a) a tubular pole supported at a lower end thereof by a support surface;

(b) a sidewall with an opening defined by the uppermost edge of the sidewall, said tubular pole at the upper end thereof being received by said opening defined by the uppermost edge of the sidewall, said sidewall at the upper end thereof being attached to said pole to be supported thereby;

(c) a heating unit disposed within a space defined by said sidewall and spaced radially from said tubular pole;

(d) conducting means interconnecting said heating unit and said tubular pole for conducting the passage of smoke and heat from said heating unit through said tubular pole; and (e) means including arms interconnecting said tubular pole and said heating unit for stabilizing and rigidifying the connection between said heating unit and said tubular pole.

6. A tent comprising:

(a) a tubular pole supported at a lower end thereof by a support surface;

(b) a sidewall with an uppermost edge and an opening defined by the uppermost edge of the sidewall, said tubular pole having an upper end received by said opening defined by the uppermost edge of the sidewall, said sidewall having an upper end attached to said tubular pole to be supported thereby, said sidewall being formed with an entrance opening therein;

(c) a heating unit disposed within a space defined by said sidewall and spaced radially from said tubular pole;

(d) conducting means interconnecting said heating unit and said tubular pole for conducting the passage of smoke and heat from said heating unit through said tubular pole;

(e) a vessel for storing liquid disposed substantially about said tubular pole for heating liquid stored in said vessel; and (f) an outer cover and an inner cover for closing said entrance opening formed in said sidewall, said outer cover being formed of flaps on said sidewall overlying said entrance opening when in the closed position, said outer cover comprising a screen to permit ventilation of said tent when said outer cover is in the closed position, said inner cover comprising a screen to permit ventilation of said tent when said inner cover is in the closed position.

7. A tent comprising:

(a) a pole supported at a lower end thereof by a support surface;

(b) a sidewall with an uppermost edge and an opening defined by the uppermost edge of the sidewall, said pole having an upper end received by said opening defined by the uppermost edge of the sidewall, said sidewall having an upper end attached to said pole to be supported thereby; and (c) a weather cap disposed above said opening defined by the uppermost edge of said sidewall, said weather cap including a center opening for receiving said pole in supporting engagement therewith, said weather cap having a generally frusto-conical configuration, said weather cap including an inner cylindrical wall and an outer cylindrical wall, said weather cap including a slit extending from said outer cylindrical wall to said inner cylindrical wall, said weather cap overlapping in the vicinity of said slit, said weather cap including a tension spring interconnecting sections of said weather cap separated by said slit for urging an inner cylindrical edge of said weather cap to grip said pole for said pole to support said weather cap.

* * * * *